US009780431B2

(12) United States Patent
Bonczyk

(10) Patent No.: US 9,780,431 B2
(45) Date of Patent: Oct. 3, 2017

(54) DUAL CAPACITIVELY COUPLED COAXIAL CABLE TO AIR MICROSTRIP TRANSITION

(71) Applicant: CommScope Technologies LLC, Hickory, NC (US)

(72) Inventor: Michael Francis Bonczyk, McAllen, TX (US)

(73) Assignee: CommScope Technologies LLC, Hickory, NC (US)

( * ) Notice: Subject to any disclaimer, the term of this patent is extended or adjusted under 35 U.S.C. 154(b) by 644 days.

(21) Appl. No.: 13/765,029

(22) Filed: Feb. 12, 2013

(65) Prior Publication Data

US 2014/0225686 A1 Aug. 14, 2014

(51) Int. Cl.

| | |
|---|---|
| ***H01P 5/08*** | (2006.01) |
| ***H01P 5/02*** | (2006.01) |
| ***H01Q 9/16*** | (2006.01) |
| ***H01Q 9/28*** | (2006.01) |

(52) U.S. Cl.

CPC ..... *H01P 5/085* (2013.01); *H01P 5/028* (2013.01); *H01Q 9/16* (2013.01); *H01Q 9/285* (2013.01)

(58) Field of Classification Search

CPC . H01Q 1/38; H01Q 9/16; H01Q 9/285; H01P 5/085; H01P 5/028

USPC ..... 343/700 MS, 862, 905, 795, 859, 860; 333/26, 260, 33, 246

See application file for complete search history.

(56) References Cited

U.S. PATENT DOCUMENTS 4,001,834 A * 1/1977 Smith ..... H01Q 13/08 333/238
5,742,258 A * 4/1998 Kumpfbeck ..... H01Q 1/246 343/700 MS
8,350,638 B2 * 1/2013 White ..... H01P 5/028 333/24 C
8,466,758 B1 * 6/2013 Tsironis ..... H01P 5/04 333/17.3
2010/0259451 A1 10/2010 Chang et al.
(Continued)

FOREIGN PATENT DOCUMENTS

| | | |
|---|---|---|
| DE | 202008016388 | 4/2009 |
| WO | WO2007/039303 | 4/2007 |

OTHER PUBLICATIONS

European Communication pursuant to Article 94(3) EPC for corresponding EP Application No. EP 14152645.9, Jun. 16, 2016, 6 pages.

*Primary Examiner* — Michael C Wimer
(74) *Attorney, Agent, or Firm* — Myers Bigel, P.A.

(57) ABSTRACT

A transmission line transition that couples RF energy between a coaxial cable and an air dielectric microstrip is provided. In some embodiments, the transition can combine a thin printed circuit board substrate and an insulating surface to form an effective capacitive coupling transition that can couple RF energy from the center conductor of a coaxial cable to an air microstrip. In some embodiments, the transition can include an insulating system affixed to a metallic surface, and the insulating system can secure an airstrip conductor in close proximity to an inner conductor of a coaxial cable to capacitively couple the airstrip conductor to the inner conductor of the coaxial cable. In some embodiments, the transition can employ a metallic body coated with an insulating surface to capacitively couple RF energy from the center conductor of the coaxial cable to the air microstrip.

17 Claims, 7 Drawing Sheets

(56) References Cited

U.S. PATENT DOCUMENTS

| | | | |
|---|---|---|---|
| 2011/0241965 | A1 | 10/2011 | Wu et al. |
| 2012/0302088 | A1 | 11/2012 | Van Swearingen et al. |

* cited by examiner

DUAL CAPACITIVELY COUPLED COAXIAL CABLE TO AIR MICROSTRIP TRANSITION

FIELD

The present invention relates generally to RF signal transmission. More particularly, the present invention relates to a dual capacitively coupled coaxial cable to air microstrip transition.

BACKGROUND

In many base station antennas, it is often necessary to incorporate several types of radio frequency (RF) transmission lines in the signal path, from the antenna input connector to the antenna radiating elements. For example, the electrical signal path in a base station antenna can include coaxial cable, printed circuit board microstrips, and air dielectric microstrips, in various combinations.

When different types of transmission lines interface with one another, the signal moves from a first transmission line to a second transmission line. At these junctions, it is critical to maintain transmission line impedance and to avoid and/or minimize introducing passive intermodulation (PIM).

Furthermore, many known electrical RF connections include solder to couple metal-to-metal compression interfaces. Solder mandates that components be made from materials that can accept solder, and typically these materials include a tin-plated brass or a tin-plated copper. Both brass and copper are relatively dense materials and have a relatively high cost as compared to aluminum, which is a relatively light and low cost material. However, aluminum does not accept a solder application.

In view of the above, there is a continuing, ongoing need for an improved transmission line transition.

SUMMARY

A transmission line transition that transitions from a coaxial cable to an air dielectric microstrip is disclosed herein.

In some embodiments, the transition can combine a thin printed circuit board substrate and an insulating surface to form an effective capacitive coupling transition that can couple RF energy from the center conductor of a coaxial cable to an air microstrip.

In some embodiments, the transition can include an insulating system affixed to a metallic surface. The insulating system, which can include an adhesive, can secure an airstrip conductor in close proximity to an inner conductor of a coaxial cable to capacitively couple the airstrip conductor to the inner conductor of the coaxial cable.

In some embodiments, the transition can employ a metallic surface coated with an insulating surface, for example, an aluminum body coated with an anodized surface, to capacitively couple RF energy from the center conductor of the coaxial cable to the air microstrip. In these embodiments, the anodized surface can effectively prevent the center conductor of the coaxial cable and the air microstrip from contacting both each other and the metallic surface.

DETAILED DESCRIPTION

Figure 1:
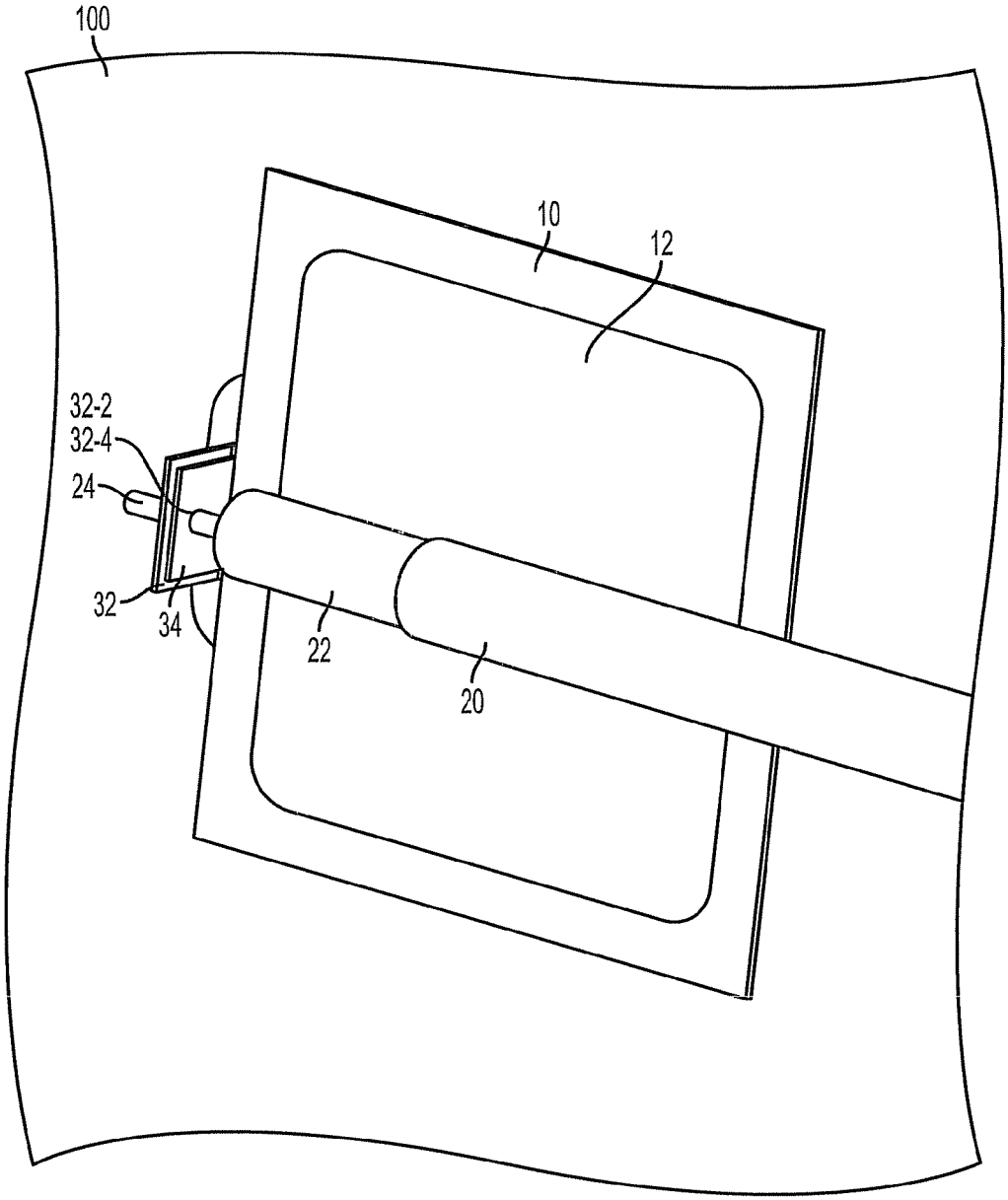
FIG. 1 is a perspective view of a bottom side of a dual capacitively coupled transition in accordance with disclosed embodiments.

While this invention is susceptible of an embodiment in many different forms, there are shown in the drawings and will be described herein in detail specific embodiments thereof with the understanding that the present disclosure is to be considered as an exemplification of the principles of the invention. It is not intended to limit the invention to the specific illustrated embodiments.

Embodiments disclosed herein include a transition that couples RF energy between a coaxial cable transmission line conductor and a microstrip transmission line conductor with no or minimal metal-to-metal contact. For example, the transition disclosed herein can include one or more conductive surfaces that are partially or fully coated with one or more insulating materials. The insulating surfaces can secure the coaxial cable conductors in close proximity to the microstrip conductors while also preventing direct metal-to-metal contact between the coaxial cable conductors and the microstrip conductors. Some embodiments disclosed herein can incorporate components that have both electrically conducting and electrically insulating properties so that the transition maintains electrical coupling without significantly introducing PIM.

In accordance with disclosed embodiments, the coaxial cable to air microstrip transition disclosed herein can be cost effective from a parts, labor, and capital cost perspective. For example, the disclosed transition can avoid costly mechanical fastening techniques. Instead, the disclosed transition can economically implement and employ capacitive coupling to optimize the electrical performance of the transition.

Some embodiments disclosed herein can combine a thin printed circuit board substrate and an insulating surface to form an effective capacitive coupling transition that can couple RF energy from the center conductor of a coaxial cable to an air microstrip. For example, in some embodiments, the printed circuit board can have a thickness of approximately 0.005 inches, and in some embodiments, the insulating surface can have a thickness of approximately 0.002 inches.

The center conductor of the coaxial cable can be soldered to an exposed copper laminate of the printed circuit board. In some embodiments, an insulating boundary, such as insulating paint or a solder mask, can be applied to a first portion of the printed circuit board to ensure that solder is directly applied to only a specific location thereon, that is, at the point where the center conductor of the coaxial cable contacts the copper laminate of the printed circuit board.

A thin film of adhesive can be applied to a second, larger portion of the printed circuit board and can be used to affix the printed circuit board to the air microstrip. In some embodiments, a portion of the copper laminate can be etched from one side of the printed circuit board and be replaced with the adhesive, thereby using the printed circuit board substrate to serve as an additional insulating boundary.

In embodiments disclosed herein, both the adhesive and the solder mask can function as an insulating surface. When secured together, the copper laminate surface, the solder mask, and the adhesive can effectively couple or connect RF signals from the center conductor of the coaxial cable to the air microstrip while preventing the center conductor from directly contacting the air microstrip.

It is to be understood that embodiments of the capacitive coupling transitions disclosed herein are not limited to printed circuit board implementations. For example, in lieu of a printed circuit board, some embodiments can include a formed, molded, extruded, or machined solderable or non-solderable metal profile, or a molded or machined metallized plastic profile, with an insulating surface, such as a thin, non-conductive film or an insulating, non-conductive coating, painted or deposited thereon. In addition to the other conductive metals disclosed herein, the conductive surfaces of the transitions disclosed herein can include, for example, alloys, such as brass, copper, bronze, aluminum, zinc, and other non-ferrous and non-magnetic metals.

It is also to be understood that the insulating surface disclosed herein can include any or all of the following materials, alone or in combination: a thin insulating adhesive, such as a high strength adhesive and/or a double sided adhesive tape; a thin, non-conductive insulating film; non-conductive clips; insulating rivets; and/or an insulating deposit, coating, or treatment, such as paint, a solder mask, a chemical film, or an anodized coating.

In some embodiments, a thin, non-conductive film or coating can be painted or deposited on strategic portions of the conductive portion of the transition to prevent direct metal-to-metal contact with conductors of the coaxial cable and microstrip components. Similarly, in lieu of or in addition to an insulating surface, some embodiments can include an insulating adhesion system, such as one or more nonconductive clips, to secure the transition in place in close proximity to the conductors of the coaxial cable and microstrip components. Accordingly, the transitions disclosed herein can provide effective RF capacitive coupling between the coaxial cable and microstrip conductors.

In accordance with the above, FIG. 1 is a perspective view of a bottom side of a dual capacitively coupled transition in accordance with disclosed embodiments. The dual capacitively coupled transition can include a first transition that capacitively couples an outer conductor of a coaxial cable to a microstrip ground plane, and a second transition that capacitively couples an inner conductor of the coaxial cable to conductive circuitry of a microstrip.

For example, as seen in FIG. 1, a printed circuit board 10 can be affixed to a ground plane 100. In some embodiments, the printed circuit board 10 can include an adhesive (not shown) affixed to a first side thereof for attaching the printed circuit 10 board to the ground plane 100, and a second side of the printed circuit board 10 can include an exposed copper trace 12. As seen in FIG. 1, an outer conductor 22 of a coaxial cable 20 can be exposed, and the outer conductor 22 can be capacitively coupled to a ground plane conductor, via the printed circuit board 10.

Figure 2:
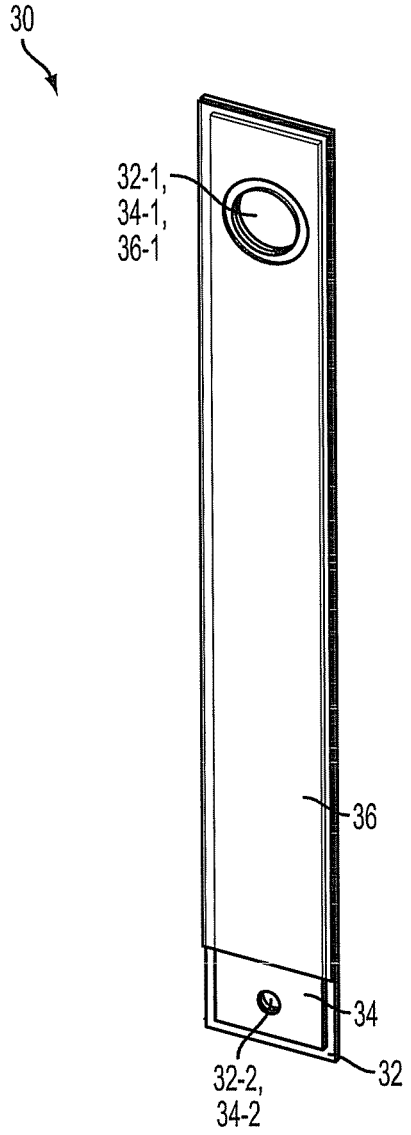
FIG. 2 is a perspective view of a printed circuit board structure in accordance with disclosed embodiments.

The center, inner conductor 24 of the coaxial cable 20 can also be exposed and can be soldered to an exposed copper trace 34 on a printed circuit board 32. For example, FIG. 2 is a perspective of a printed circuit board structure 30 in accordance with disclosed embodiments. As seen in FIG. 2, the structure 30 can include a printed circuit board 30 having first and second apertures 32-1, 32-2 near respective first and second ends thereof. A copper trace 34 can be exposed on the printed circuit board 32, and the copper trace 34 can also include first and second apertures 34-1, 34-2 near respective first and second ends thereof. In some embodiments, the copper trace 34 can provide a high capacitance coupling surface to an airstrip. Furthermore, in some embodiments, the copper trace 34 can be offset from the edges of the printed circuit board 32 as seen in FIG. 2.

An insulating surface 36, such as an insulating adhesive, a thin insulating film, or an insulating coating, can be affixed to at least a portion of the length of the printed circuit board 32 and copper trace 34 and include an aperture 36-1 near a first end thereof. In some embodiments, the insulating surface 36 can function as an insulating capacitive barrier to prevent the printed circuit board 32 and copper trace 34 from directly contacting the air microstrip. Furthermore, in some embodiments, the insulating surface 36 can be offset from a second end of the printed circuit board 32 and the copper trace 34 as seen in FIG. 2. That is, the insulating surface 36 can be shorter than the copper 34 trace so that portions of the printed circuit board 32 and copper trace 34 are exposed and not covered by the insulating surface 36. In some embodiments, portions of the printed circuit board 32 and copper trace 34 that include the second apertures 32-2, 34-2 can be exposed and not covered by the adhesive 36.

Figure 3:
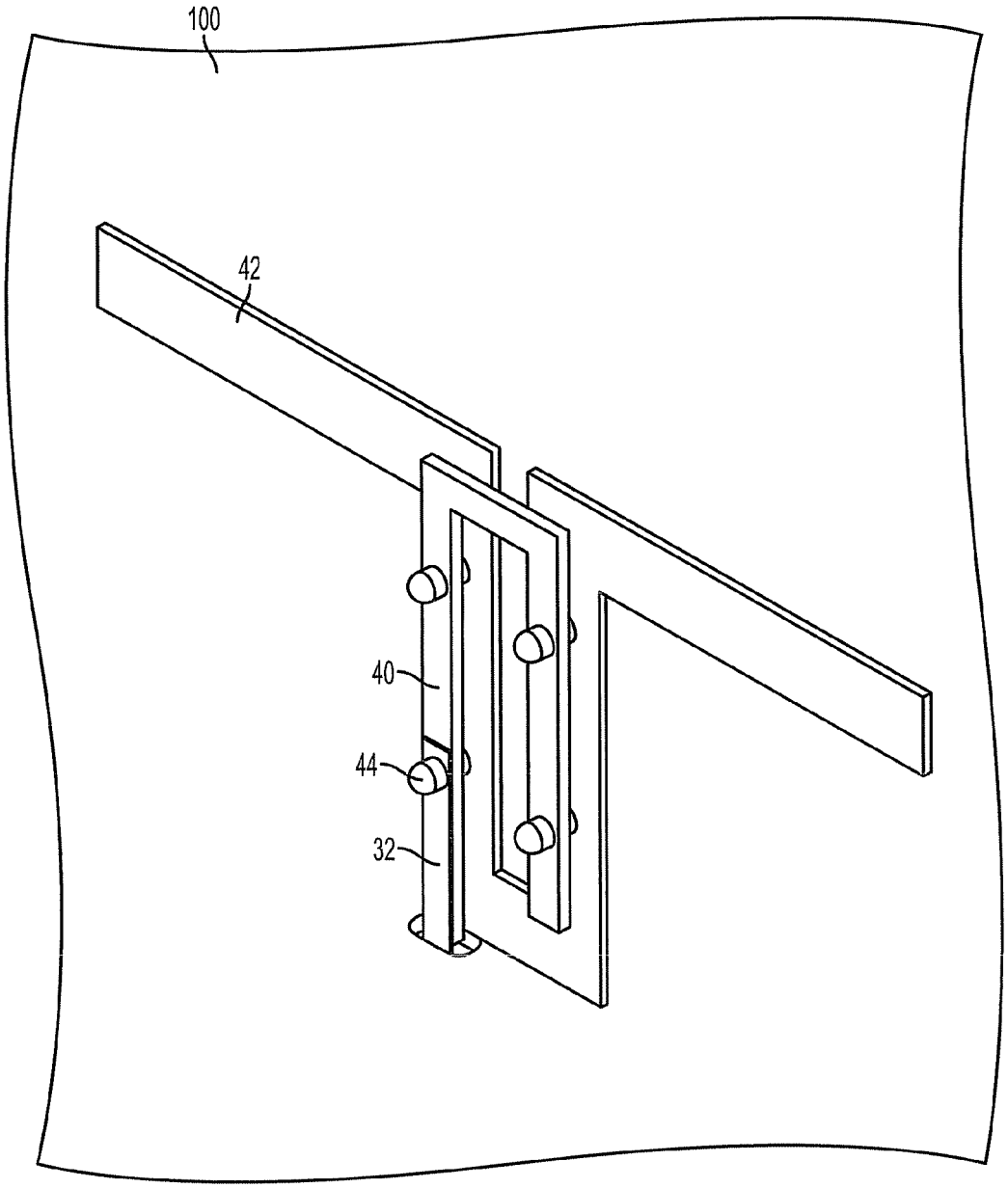
FIG. 3 is a perspective view of a top side of a dual capacitively coupled transition in accordance with disclosed embodiments.

Referring now to FIG. 3, a perspective view of a top side of a dual capacitively coupled transition in accordance with disclosed embodiments is shown. As seen in FIG. 3, the insulating surface 36 can be affixed to an airstrip conductor 40 to attach the structure 30 of FIG. 2 to the airstrip conductor 40. In some embodiments, the insulating surface 36 can provide a capacitive barrier between the airstrip conductor 40 and the insulated portion of the copper trace 34.

In some embodiments, the airstrip conductor 40 can be associated with a dipole 42 as would be known by those of skill in the art. In some embodiments, the airstrip conductor 40 can include a standard air dielectric microstrip transmission line as would be known by those of skill in the art.

In some embodiments, a nonconductive molded clip 44 can be disposed through the apertures 32-1, 34-1, 36-1 of the printed circuit board 32, the copper trace 34, and the insulating surface 36 near the respective first ends thereof to further attach and secure the structure 30 to the airstrip conductor 40. In some embodiments, the apertures 32-1, 34-1, 36-1 and the clip 44 can be used to align the printed circuit board 32, the copper trace 34, and the insulating surface 36 with respect to one another and with respect to the airstrip conductor 40.

Figure 4:
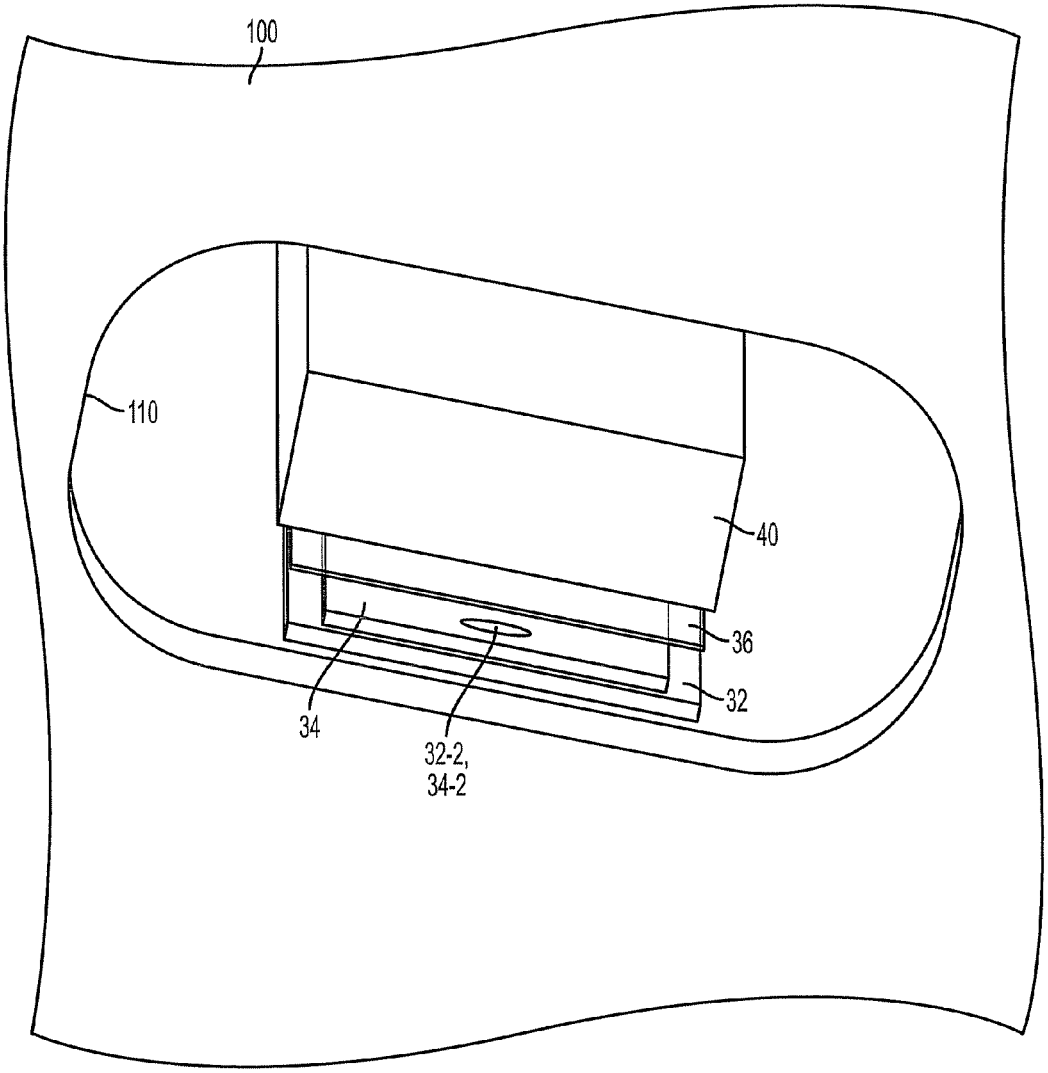
FIG. 4 is a bottom side view of a printed circuit board structure disposed through an aperture in a ground plane in accordance with disclosed embodiments.

The ground plane 100 can include an aperture 110 disposed therein, and at least a portion of the printed circuit board structure 30 of FIG. 2 can be disposed through the aperture 110. FIG. 4 is bottom side view of the printed circuit board structure 30 disposed through the aperture 110 in the ground plane 100. As seen in FIG. 4, at least the second ends of the printed circuit board 32 and the copper trace 34, including the respective second apertures 32-2, 34-2 therein, can be disposed through the aperture 110 in the ground plane 100. In some embodiments, at least a second end of the insulating surface 36 can also be disposed through the aperture 110 in the ground plane 100.

Referring again to FIG. 1, at least a portion of the center, inner conductor 24 of the coaxial cable 20 can be disposed through the respective second apertures 32-2, 34-2 in the printed circuit board 32 and the copper trace 34. In some embodiments, solder can be applied to the connection between the center, inner conductor 24 of the coaxial cable 20 and the copper trace 34 to secure the connection therebetween.

In accordance with some embodiments, effective capacitive coupling transitions disclosed herein can further reduce cost by making larger antenna components, such as radiating elements and airstrip transmission lines, from aluminum, which is more economical than expensive solderable alloys, such as brass. Transitions disclosed herein can also provide economic advantages by providing improved thermal dynamic characteristics. For example, the electrically insulating materials that prevent direct metal-to-metal contact can also act as thermal barriers between conductors. Thermal barriers between a small conductive surface of a transition and larger coaxial cable or airstrip conductors can prevent heat flow away from the solder joint, which results in a more stable thermal profile during soldering. Accordingly, improved solder joints can be achieved that have more repeatable electrical and mechanical properties, which can result in higher reliability from a PIM perspective.

In accordance with the above, some embodiments disclosed herein can include transitions that employ a conductive capacitive surface, such as an economical aluminum alloy, and an insulating boundary, such as an anodized surface coating. These embodiments of the transition disclosed herein can provide capacitive coupling between the conductive surfaces of the main transition body and the conductors of the coaxial cable and the microstrip, thereby eliminating metal-to-metal contact and the need for solder. For example, a purely capacitive transition can provide a capacitive coupling path between a conductor of the coaxial cable and the transition conductive body and between the transition conductive body and a conductor of the airstrip transmission line.

Figure 5:
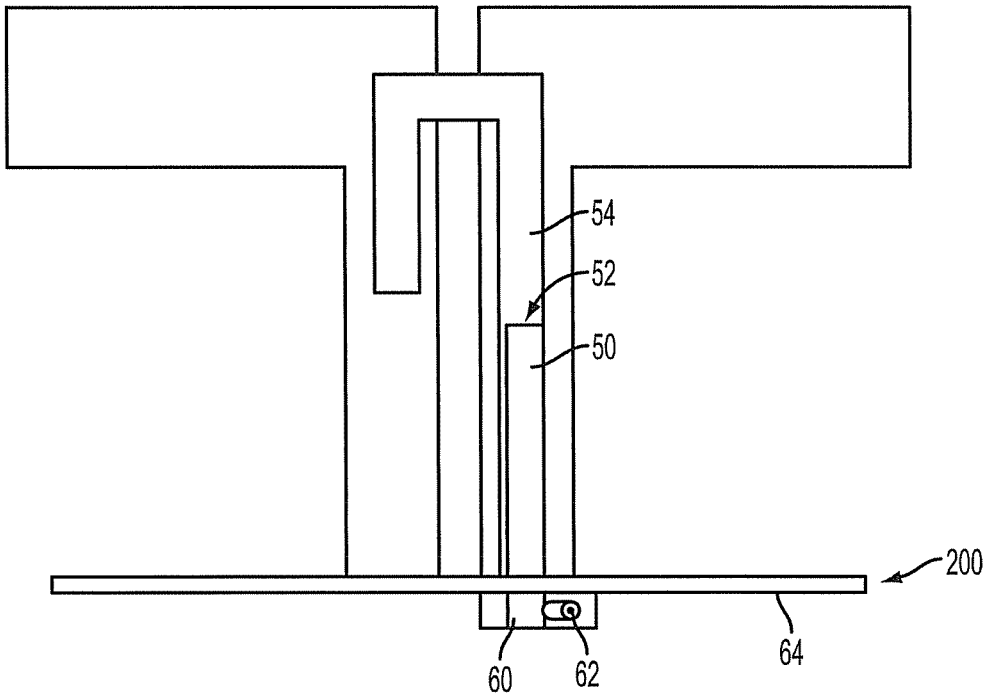
FIG. 5 is a side view of a dual capacitively coupled transition in accordance with disclosed embodiments.

FIG. 5 is a side view of a dual capacitively coupled transition in accordance with disclosed embodiments. As seen in FIG. 5, the dual capacitively coupled transition can include a first transition on a first side of a ground plane 200, and a second transition on a second side of the ground plane 200. The first transition can couple RF energy from an inner conductor 52 of a coaxial cable to an airstrip conductor 54, and the second transition can couple RF energy from an outer conductor 62 of the coaxial cable to a ground plane conductor 64, for example, a reflector. In some embodiments, the dual capacitively coupled transition shown in FIG. 5 can include an insulating system that surrounds the conductive surfaces of each transition. For example, a formed, molded, machined, or extruded aluminum profile can be coated with a thin anodized insulating surface.

Figure 6:
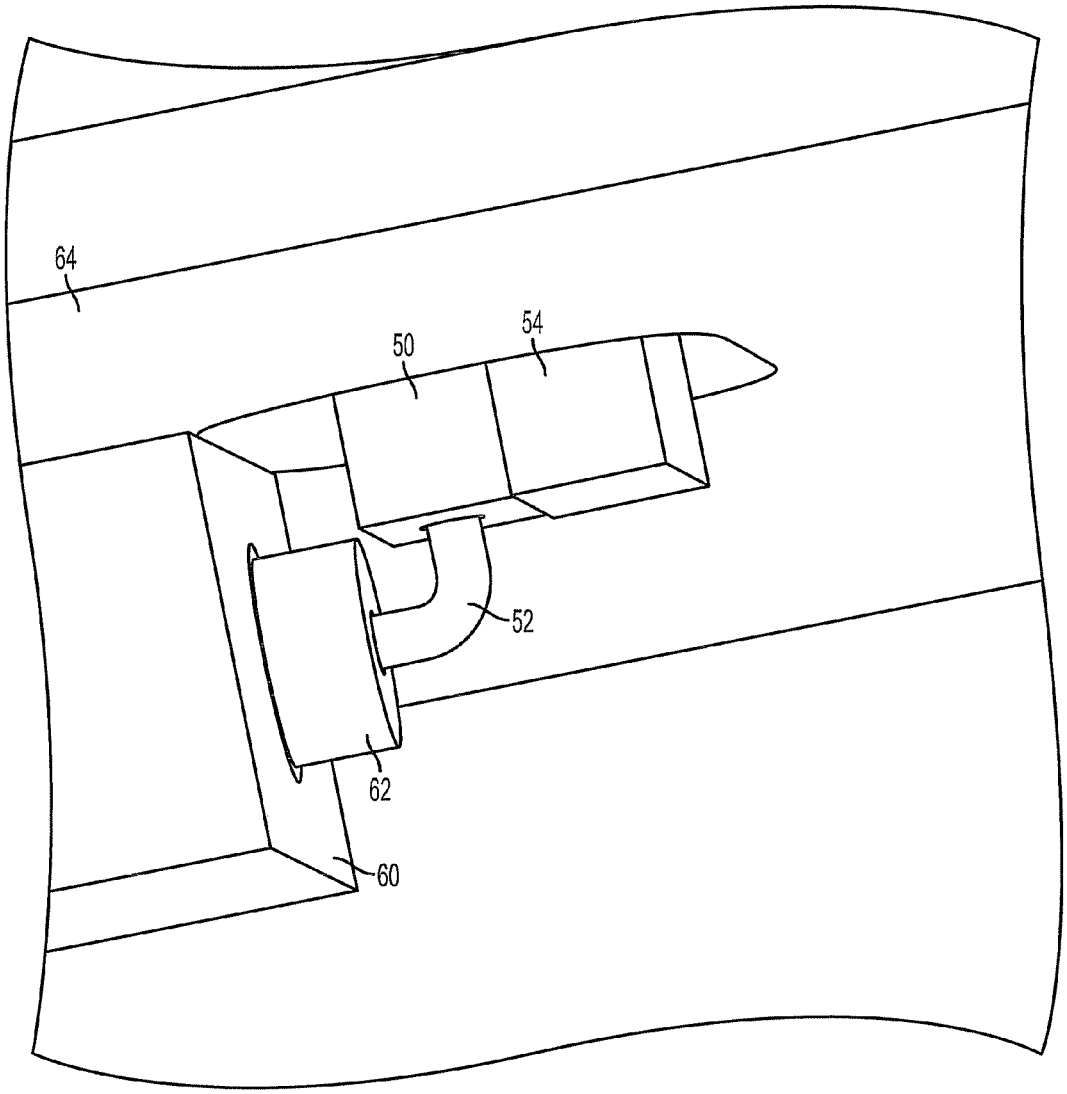
FIG. 6 is a perspective view of a bottom side of a dual capacitively coupled transition in accordance with disclosed embodiments.

FIG. 6 is a perspective view of a bottom side view of a dual capacitively coupled transition in accordance with disclosed embodiments. As seen in FIG. 6, the outer conductor 62 of the coaxial cable can be coupled to ground plane conductor 64, or reflector, via the second transition. In some embodiments, the second transition can include a main body 60 that can be, for example, an aluminum material. For example, the main body 60 of the second transition can be light, economical, and formed via extrusion manufacturing.

In some embodiments, the main body 60 of the second transition can include an insulating anodized surface or coating thereon. For example, the insulating anodized surface or coating can provide a durable and insulating capacitive junction between outer conductor 62 and the main transition body 60 and between the main transition body 60 and the ground plane conductor 64. In some embodiments, the second transition can also include an insulating surface, for example, an adhesive or nonconductive clip, that can be affixed at the second transition boundary interface. For example, the insulating surface can be affixed on the second transition body 60 or on the ground plane conductor 64 so as to affix the second transition body 60 to the ground plane conductor 64 while preventing the second transition body 60 from directly contacting the ground plane conductor 64. The insulating surface can also secure the outer conductor 62 in close proximity to the ground plane conductor 64 while preventing direct conductive contact.

Figure 7:
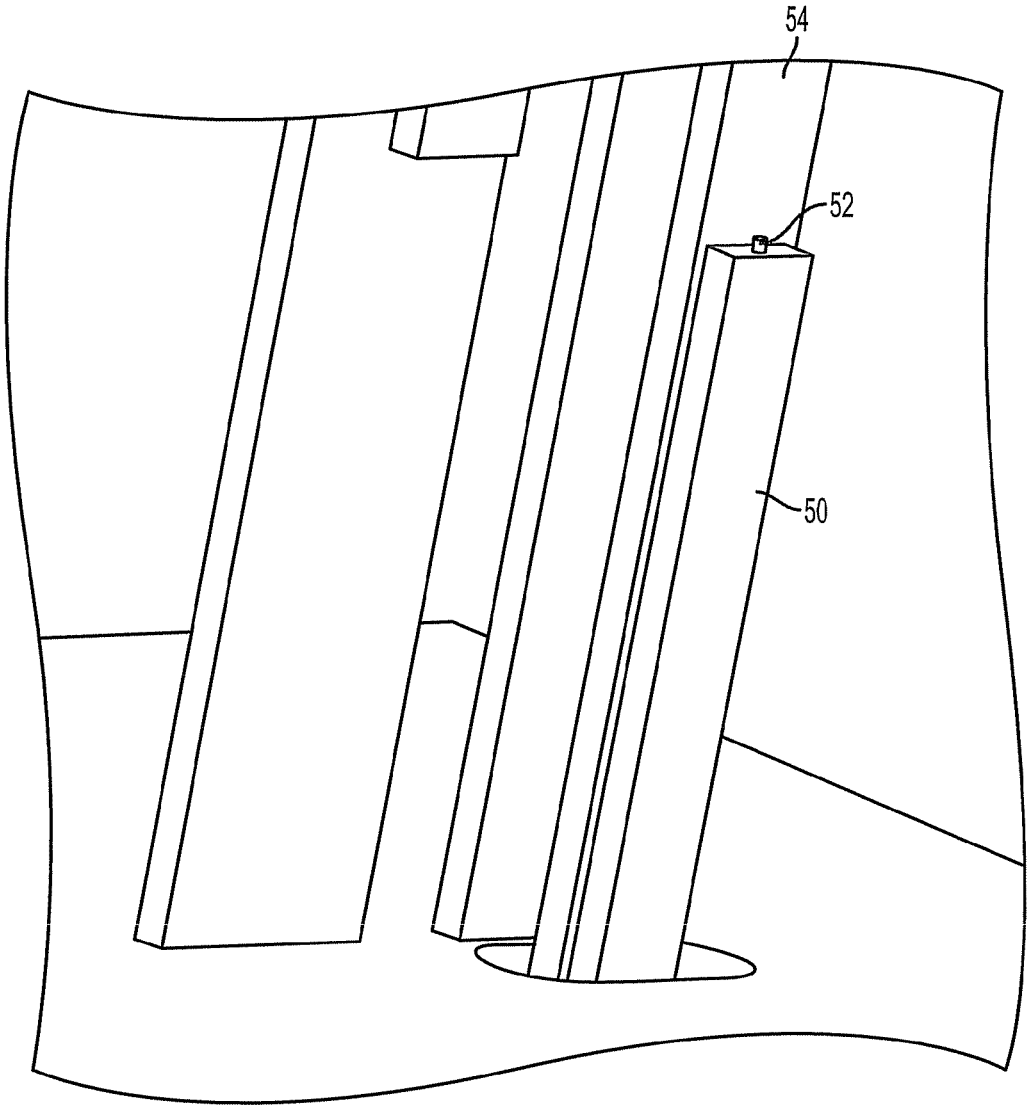
FIG. 7 is a perspective view of a top side of a dual capacitively coupled transition in accordance with disclosed embodiments.

FIG. 7 is a perspective view of a top side of a dual capacitively coupled transition in accordance with disclosed embodiments. As seen in both FIG. 6 and FIG. 7, the inner conductor 52 of a coaxial cable can be coupled to the airstrip conductor 54 via the first transition. In some embodiments, the first transition can include a main body 50 that can be, for example, an aluminum material. For example, the main body 50 of the first transition can be light, economical and formed via extrusion manufacturing. In some embodiments, a center aperture can be disposed along a length of the main body 50 of the first transition, and the center conductor 52 can be disposed through the aperture for coupling the center conductor 52 to the main body 50 of the first transition. In some embodiments, an anodized insulating coating can be applied between the conductive surfaces of the center conductor 52 and the center aperture to prevent direct metal-to-metal contact.

In some embodiments, the main body 50 of the first transition can include an insulating anodized surface or coating thereon. For example, the insulating anodized surface or coating can provide a durable and insulating capacitive junction between the inner conductor 52 and the main transition body 50 and between the main transition body 50 and the airstrip conductor 54. In some embodiments, the first transition can also include an insulating surface, for example, an adhesive or nonconductive clip, that can be affixed at the first transition boundary interface. For example, the insulating surface can be affixed on the first transition body 50 or on the airstrip conductor 54 so as to affix the first transition body 50 to the airstrip conductor 54 while preventing the first transition body 50 from directly contacting the airstrip conductor 54. The insulating surface can also secure the inner conductor 52 in close proximity to the airstrip conductor 54 while preventing direct conductive contact.

From the foregoing, it will be observed that numerous variations and modifications may be effected without departing from the spirit and scope of the invention. It is to be understood that no limitation with respect to the specific system or method illustrated herein is intended or should be inferred. It is, of course, intended to cover by the appended claims all such modifications as fall within the spirit and scope of the claims.

What is claimed is:

1. A coaxial cable to air microstrip transition comprising:

a printed circuit board; and an insulating surface, wherein a first side of the insulating surface is affixed to a first portion of the printed circuit board on a first side of the printed circuit board, wherein a second portion of the printed circuit board on the first side of the printed circuit board is free of coverage by the insulating surface, wherein a second side of the insulating surface is affixed to an airstrip conductor, wherein the second portion of the printed circuit board is electrically connected to an inner conductor of a coaxial cable, and wherein the printed circuit board extends through an aperture in a ground plane so that at least the first portion of the printed circuit board and the insulating surface are disposed on a first side of a ground plane and so that at least the second portion of the printed circuit board is disposed on a second side of the ground plane.

2. The coaxial cable to air microstrip transition of claim 1 wherein the insulating surface includes at least one of an insulating adhesive, a double sided tape, an insulating film, an insulating deposit, paint, a solder mask, a chemical film, and an anodized surface.

3. The coaxial cable to air microstrip transition of claim 1 wherein the first side of the printed circuit board includes a copper laminate, and wherein the inner conductor of the coaxial cable is soldered to the copper laminate.

4. The coaxial cable to air microstrip transition of claim 3 wherein the copper laminate provides a high capacitance coupling surface between the inner conductor of the coaxial cable and the airstrip conductor.

5. The coaxial cable to air microstrip transition of claim 3 wherein the copper laminate is offset from edges of the printed circuit board.

6. The coaxial cable to air microstrip transition of claim 3 wherein the insulating surface provides a capacitive barrier to prevent the printed circuit board and the copper laminate from directly contacting the airstrip conductor.

7. The coaxial cable to air microstrip transition of claim 1 further comprising a second printed circuit board affixed to the second side of the ground plane, wherein an outer conductor of the coaxial cable is electrically connected to the second printed circuit board.

8. The coaxial cable to air microstrip transition of claim 7 wherein the outer conductor of the coaxial cable is capacitively coupled to a ground plane conductor.

9. The coaxial cable to air microstrip transition of claim 7 wherein the second printed circuit board includes a second insulating surface to affix a first side of the second printed circuit board to the second side of the ground plane.

10. The coaxial cable to air microstrip transition of claim 1 wherein the first portion of the printed circuit board and the insulating surface each include a first aperture, wherein the first aperture of the printed circuit board is aligned with the first aperture of the insulating surface, and wherein a clip is disposed through each of the first apertures of the printed circuit board and the insulating surface for securing the printed circuit board and the insulating surface to the airstrip conductor.

11. The coaxial cable to air microstrip transition of claim 10 wherein the clip includes a non-conductive clip.

12. The coaxial cable to air microstrip transition of claim 1 wherein the second portion of the printed circuit board includes a second aperture, and wherein the inner conductor of the coaxial cable is disposed through the second aperture of the printed circuit board.

13. An antenna comprising:

a coaxial cable;

an airstrip conductor;

a printed circuit board; and an insulating surface, wherein a first side of the insulating surface is affixed to a first portion of the printed circuit board on a first side of the printed circuit board, wherein a second portion of the printed circuit board on the first side of the printed circuit board is free of coverage by the insulating surface, wherein a second side of the insulating surface is affixed to the airstrip conductor, and wherein the second portion of the printed circuit board is electrically connected to an inner conductor of the coaxial cable, and wherein the printed circuit board extends through an aperture in a ground plane so that at least the first portion of the printed circuit board and the insulating surface are disposed on a first side of a ground plane and so that at least the second portion of the printed circuit board is disposed on a second side of the ground plane.

14. The antenna of claim 13 wherein the inner conductor of the coaxial cable is capacitively coupled to the airstrip conductor.

15. The antenna of claim 13 wherein the insulating surface provides a capacitive barrier to prevent a copper trace on the printed circuit board from directly contacting the airstrip conductor.

16. The antenna of claim 13 further comprising a feed board, wherein an outer conductor of the coaxial cable is electrically connected to the feed board.

17. The antenna of claim 16 wherein the outer conductor of the coaxial cable is capacitively coupled to a ground plane conductor.

* * * * *